United States Patent [19]

Holman

[11] Patent Number: 4,497,491

[45] Date of Patent: Feb. 5, 1985

[54] APPARATUS AND METHOD EMPLOYING SELECTIVELY STACKABLE GAME PIECES

[76] Inventor: Paul D. Holman, 919 E. Kaler Dr., Phoenix, Ariz. 85020

[21] Appl. No.: 563,237

[22] Filed: Dec. 19, 1983

[51] Int. Cl.[3] ..... A63F 3/00

[52] U.S. Cl. ..... 273/271; 273/290

[58] Field of Search ..... 273/271, 287, 290

[56] References Cited

U.S. PATENT DOCUMENTS

| | | | |
|---|---|---|---|
| 2,485,143 | 10/1949 | Duncan | 273/271 X |
| 3,186,716 | 6/1965 | Shabarick | 273/290 |
| 3,556,526 | 1/1971 | Currie | 273/271 X |
| 3,806,125 | 4/1974 | Bialek | 273/290 X |
| 4,285,522 | 8/1981 | Turner | 273/271 X |

*Primary Examiner*—Harland S. Skogquist

*Attorney, Agent, or Firm*—Cahill, Sutton & Thomas

[57] ABSTRACT

A plurality of geometrically arranged circular depressions are formed in a game board to nestingly receive one or a stack of game pieces. The game pieces, which may be in the shape of discs, are stackable in ascending order reflective of the valuation assigned to each and which valuation is indicated by a raised symbol on the upper surface of each game piece. The lower surface of each game piece includes an indentation configured to mate with a lower valuation symbol formed on the upper surface of another game piece to interlock the game pieces when stacked and regulate the stacking order. To play the game, each of the players is given a set of game pieces. Taking turns, the players attempt to align a specific number of uncovered ones of their game pieces of a common valuation upon the game board and any existing stacks; variations in object and mode of play are contemplated.

25 Claims, 9 Drawing Figures

APPARATUS AND METHOD EMPLOYING SELECTIVELY STACKABLE GAME PIECES

The present invention is related to articles for amusement and, more particularly to a game.

The game of tic-tac-toe is well known and has been played by children and adults for many generations. The rules are simple and the materials required are limitlessly substitutable and yet the game can be played on many different levels of skill. A game sometimes referred to as "Paper, Scissors and Rock" has been played by children for generations. In this game, "paper covers stone", "scissors cut paper" and "stone breaks scissors" whereby each item has a valuation superior to one but inferior to the other. During each round of play, the players simultaneously call out or make signs representative of one or another of the three items. Whichever player's item is superior to the remaining ones, wins that round.

The present invention is an embodiment for a game which combines the salient features of the games of tic-tac-toe and paper, scissors and rock. A game board contains a matrix of 3×3 positions. Each playing piece depicts a symbol on its upper surface representative of either paper, scissors or rock and the game pieces are stackable but only in order of ascending valuation. In one format of the game, each player receives eighteen playing pieces of one color, six of which represent each of paper, scissors and rock. The game is played in the manner of tic-tac-toe wherein two players alternate turns and attempt to place their playing pieces in a straight line across three positions of the game board; however, the three aligned game pieces must be uncovered and depict the same symbol. This latter requirement injects a substantial degree of difficulty since the players may play upon the other's game pieces.

It is therefore a primary object of the present invention to provide a game having simple rules and yet demanding substantial skill.

Another object of the present invention is to provide a game which can be played at any of many skill levels.

Yet another object of the present invention is to provide game pieces for a game which game requires conformation with certain rules of superiority.

Still another object of the present invention is to provide a game playable with a game board and game pieces which may be constructed in any of unlimited configurations.

A further object of the present invention is to provide a game which may be played in unlimited variations of object and mode of play with the same game board and game pieces.

A yet further object of the present invention is to provide interlocking stackable game pieces reflective of the relative valuations assigned to the game pieces and used with a matingly configured game board.

A still further object of the present invention is to provide a method for playing a game having unlimited variations in object and mode of play.

These and other objects of the present invention will become apparent to those skilled in the art as the description thereof proceeds.

The present invention may be described with greater specificity and clarity with reference to the following drawings, in which.

Figure 1:
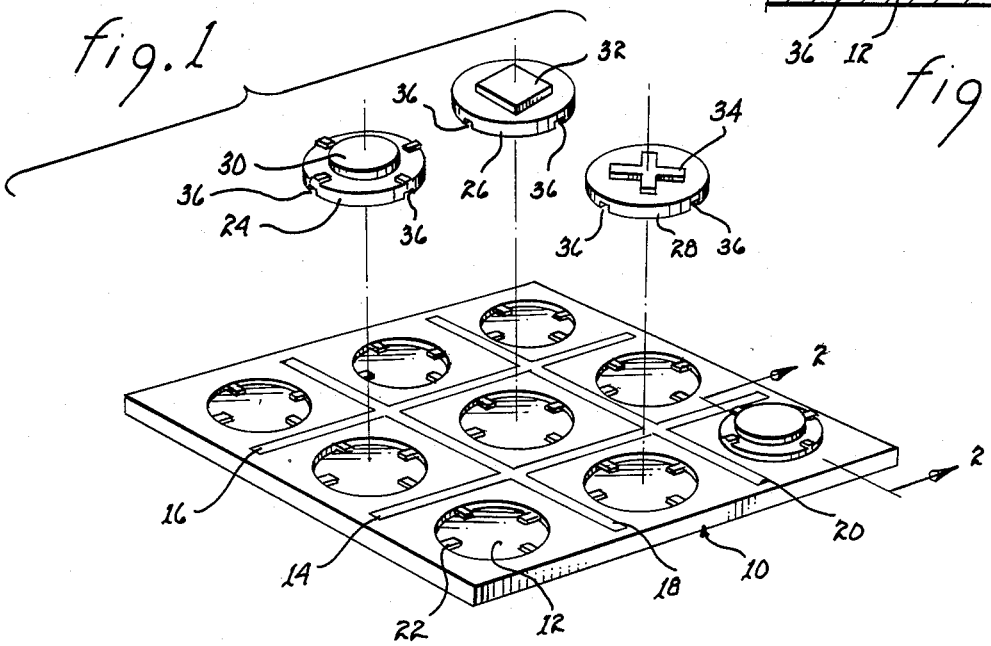
FIG. 1 illustrates in perspective view a game board and the mating relationship of game pieces.

Referring to FIG. 1, there is shown a game board 10 having a 3×3 matrix of game piece receiving positions, such as cavities 12. As a visual aid to define three rows and three columns of positions, two horizontal delineations 14, 16 and two vertical delineations 18, 20 may be incorporated in the game board. Each cavity 12 may be configured to nestingly receive one of the game pieces. Such nesting is employed to eliminate inadvertent sliding of the game pieces off the position designated by the respective cavity. To prevent rotation of a game piece placed in position, keys 22 may be formed within the cavity. These keys correspond with mating keyways in a game piece. By employing four symmetrically arranged keys, a playing piece may be engaged at any one of four angularly oriented positions.

Three differently configured game pieces 24, 26 and 28 are employed. Game piece 24 depicts a raised roundel 30 symbolically representative of "rock". Game piece 26 depicts a raised square 32 symbolically representative of "paper". Game piece 28 depicts a raised cross 34 symbolically representative of "scissors". These depicted symbols have distinct valuations: scissors are superior to paper; paper is superior to rock; and, rock is superior to scissors. Other symbology could also be selected without departing from the gist of assigning valuations to the game pieces. Each game piece includes keyways 36, four in number, symmetrically spaced about the perimeter of the bottom surface, which keyways mate with keys 24 of cavities 12.

Figure 2:
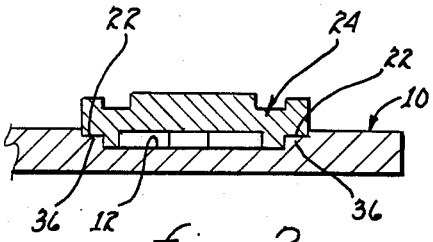
FIG. 2 is a partial cross-sectional view taken along lines 2—2, as shown in FIG. 1.

FIG. 2 illustrates game piece 24 nested within cavity 12 of game board 10. The relationship of keys 22 and the corresponding keyways 36 is illustrated. It is therefore apparent that lateral sliding or rotational movement of game piece 24 is precluded by jarring or otherwise inadvertently disturbing the game board or the game piece.

The game is usually played by two players, each of whom has a plurality of game pieces of one color. Each player, by taking an alternate turn, attempts to position his game pieces in any three cavities lying in a straight line. An opponent's game piece may be covered by stacking the game pieces provided that the covering game piece is superior in valuation to the game piece covered.

Figure 4:
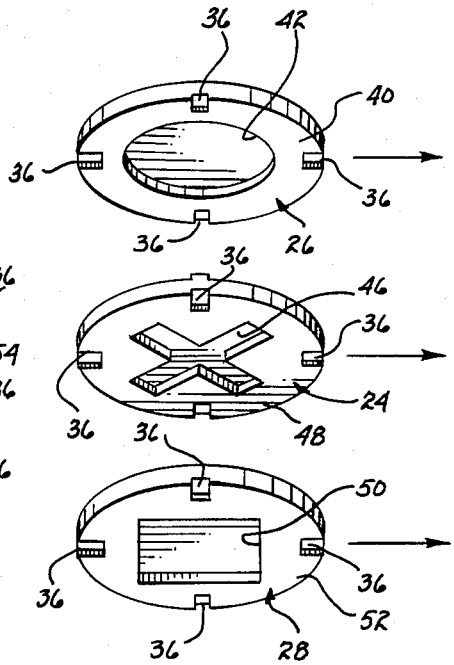
FIGS. 3 and 4 show the top and bottom surfaces, respectively, and the interlocking relationships of the three types of game pieces employed.
Figure 3:
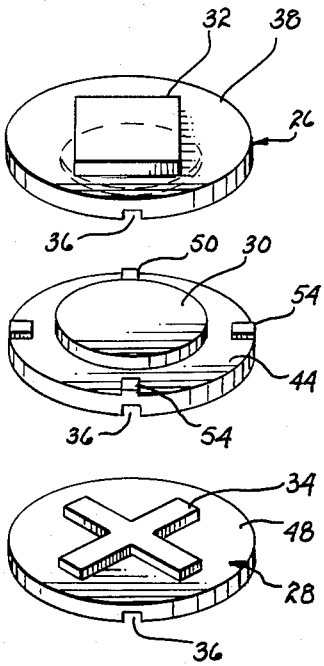

To assure ascending valuation in any stack of game pieces, the undersurface of each game piece includes an indentation commensurate with the symbol of the next inferior valuation, as depicted in FIGS. 3 and 4. Game piece 26 has a symbol or a raised square 32 extending from top surface 38, which symbol represents "paper". As "paper" is superior to "rock" the symbol for "rock" is formed in bottom surface 40 of game piece 26 by circular indentation 42. Thereby, game piece 26 can only be placed upon and mated with another game piece depicting "rock" on its top surface. Game piece 24 has roundel 30 on its top surface 44 symbolic of "rock", which roundel is sized to mate with indentation 42. Since "rock" is superior to "scissors", an indentation 46 configured as a cross and symbolic of "scissors" is formed in bottom surface 48 of game piece 24. Accordingly, game piece 24 can only be placed upon and mated with a game piece having the symbol for "scissors" on its top surface. Game piece 28 has a cross 34 raised from top surface 48. "Scissors" is superior to "paper" and an indentation 50 depicting a square symbolic of "paper" is formed in bottom surface 52 of game piece 28. It is then evident that game piece 28 can only be placed upon and mated with a game piece having the symbol for "paper" on its upper surface.

Since roundel 30 of game piece 24 and indentation 42 of game piece 26 are symmetric, rotation between the respective game pieces may result. To preclude such rotation, one or more of keys 54 depicted as extending from upper surface 44 of game piece 24 may be developed to mate with keyways 36 in bottom surface 40 of game piece 26. It may be noted that keyways 36 also mate with keys 22 in game board 10.

Figure 5:
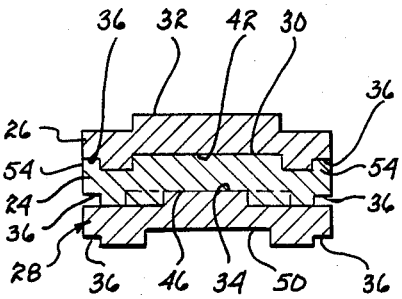
FIG. 5 illustrates a stack of interlocked game pieces.

FIG. 5 illustrates game pieces 26, 24 and 28 stacked upon one another. The symbols raised from each top surface mate and interlock with corresponding indentations in the bottom surface of the next adjacent game piece. Moreover, keys 54 of game piece 24 mate and interlock with keyways 36 of game piece 26 to prevent relative rotation between the respective game pieces.

Figure 6:
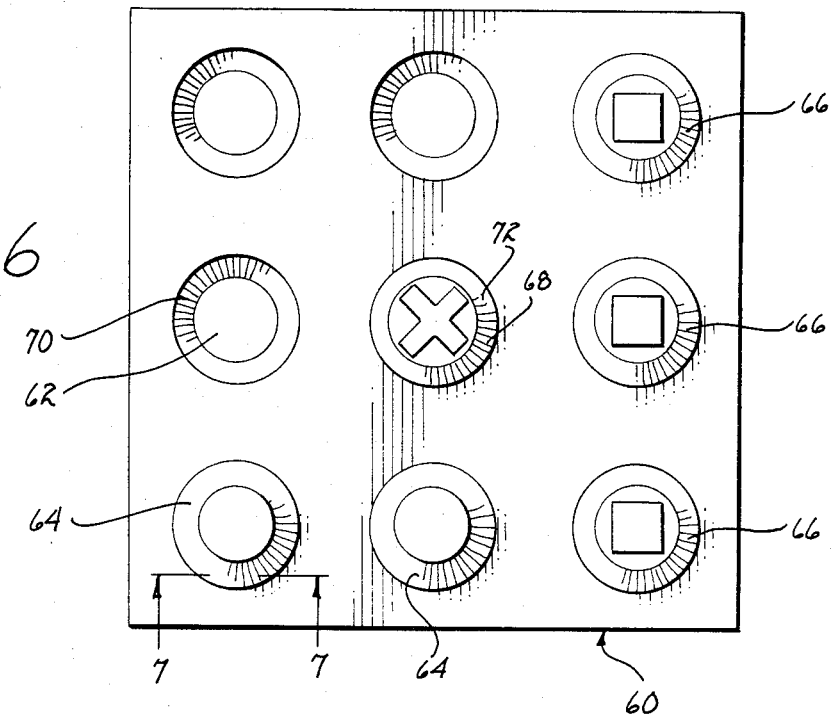
FIG. 6 is a plan view of a variant of the game board and game pieces.

Referring to FIG. 6, there is illustrated a variant game board 60 having a $3\times3$ matrix of positions, such as cavities 62. Each of game pieces 64, 66 or 68 may be placed in any one of cavities 62. Rotation intermediate a cavity and an engaged game piece is precluded by the meshing of a ribbed annular band 70 formed in cavity 62 with an equivalent ribbed annular band formed in the bottom surface of each game piece. The top surface of each game piece also includes a ribbed annular band 72 for meshing with any game piece stacked thereon. By employing such ribbed annular bands, relative rotation between the game pieces and between a game piece and the game board is precluded.

Figure 7:
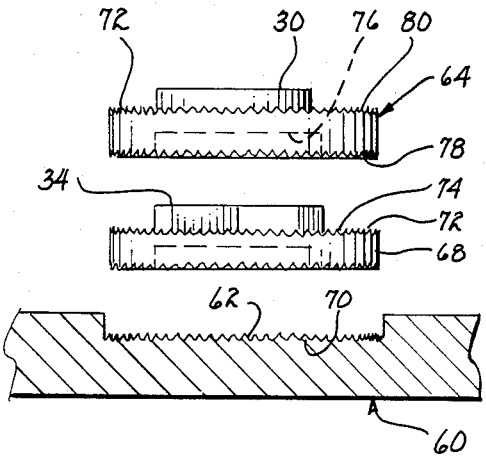
FIG. 7 is a partial cross-sectional view showing in exploded format stacking in interlocking manner of the variant game pieces.
Figure 8:
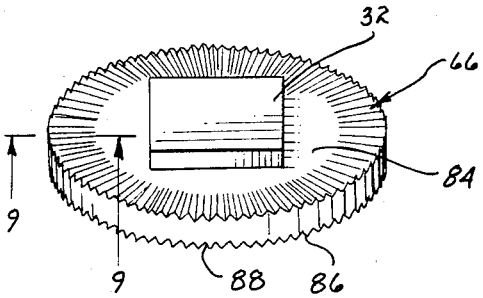
FIG. 8 is a detailed view of one of the variant game pieces.
Figure 9:
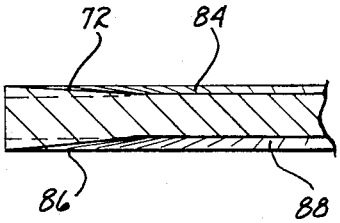
FIG. 9 is a partial cross-sectional view illustrating the annular ribbed band of the variant game pieces.

As illustrated in FIGS. 7 and 8, game piece 60 having the symbol of "scissors" formed by a cross 34 raised from top surface 74 is lodged in cavity 62. Game piece 64 having an indentation 76 configured as a cross is developed in bottom surface 78 to permit interlocking mating with game piece 68. A roundel 30 raised above top surface 80 of game piece 64 is representative of "rock". Game piece 66 (see FIG. 8) includes an indentation in its bottom surface configured as a roundel to permit placement of this game piece in mating interlocking relationship with game piece 64. A raised square 32 symbolically representative of "paper" extends from top surface 84 of game piece 66. Relative rotation between game pieces 64 and 66 is precluded by the meshing of annular band 72 in top surface 80 of game piece 64 with ribbed annular band 86 formed in bottom surface 88 of game piece 66, as clearly shown in FIG. 9.

It is to be understood that the keys and keyways shown attendant game board 10 and game pieces 24, 26 and 28 as well as the ribbed annular bands attendant variant game board 60 and variant game pieces 64, 66 and 68 are included primarily for aesthetic purposes to maintain the game pieces oriented in the case of the former and prevent distraction due to potential incremental rotation of the game pieces during play, in the case of the latter.

To play either game described above, each player may be assigned six of each type of game piece, all of which are of the same color. The second player receives an equivalent number of game pieces but of a different color. The players alternate turns and during each turn place a game piece upon the board or an existing game piece. In the case of the latter, the game piece being stacked must be of a higher valuation or superior to the underlying game piece. The object of the game is for one player to be the first to obtain three of this game pieces of the same valuation aligned in a straight line upon the game board. A number of variations that may be played are contemplated, including variations of chess, checkers, point assignments for different valuation game pieces left showing, handicapping one player by providing him with fewer game pieces, variations of the game board matrix or arrangement, and variations in the configuration of the game board and game pieces, etc.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A game of skill, said game comprising in combination:

(a) a game board;

(b) a plurality of positions delineated on said game board;

(c) at least two sets of game pieces for use with said game board, each said set of game pieces including:

i. a first plurality of game pieces having a first valuation;

ii. a second plurality of game pieces having a second valuation, which second valuation is superior to the first valuation;

iii. a third plurality of game pieces having a third valuation, which third valuation is superior to the second valuation and inferior to the first valuation; and (d) means for stacking said game pieces only in ascending order of valuation upon selected ones of said positions of said game board.

2. The game as set forth in claim 1 wherein each of said game pieces includes a symbol representative of the respective one of the first, second and third valuations.

3. The game as set forth in claim 2 wherein each said game piece includes a top surface and each said symbol comprises an element raised above said top surface of the respective one of said game pieces.

4. The game as set forth in claim 3 wherein each said game piece includes a bottom surface and an indentation in said bottom surface commensurate in configuration with the symbol of valuation inferior to the valuation of the symbol on said top surface of the respective game piece.

5. The game as set forth in claim 4 wherein said raised element depicting one symbol on one of said game pieces is nestable within said indentation depicting the same symbol in another of said game pieces to permit stacking of said game pieces in ascending order of valuation.

6. The game as set forth in claim 4 wherein said stacking means comprises nesting of the raised element of one of said game pieces with a correspondingly configured indentation of another of said game pieces.

7. The game as set forth in claim 6 wherein each of said game pieces includes means for inhibiting relative rotation between stacked ones of said game pieces.

8. The game as set forth in claim 7 wherein each of said positions of said game board includes means for inhibiting rotation of a game piece of said game pieces placed thereupon.

9. The game as set forth in claim 8 wherein each of said positions of said game board includes means for orienting any of said game pieces placed thereupon.

10. The game as set forth in claim 8 wherein each of said positions of said game board comprises a cavity for receiving one of said game pieces.

11. The game as set forth in claim 1 wherein said positions define a three by three matrix upon said game board.

12. The game as set forth in claim 11 wherein said game board includes delineations for defining three columns and three rows of said positions.

13. The game as set forth in claim 11 wherein each of said positions comprises a cavity for receiving one of said game pieces.

14. The game as set forth in claim 1 including means for inhibiting relative rotation between stacked ones of said game pieces.

15. The game as set forth in claim 14 including further means for inhibiting rotation of a game piece of said game pieces placed upon one of said positions.

16. The game as set forth in claim 15 wherein each said position comprises a cavity for receiving one of said game pieces.

17. A method for playing a game with a game board having a plurality of positions delineated thereon and at least two sets of game pieces, each said set of game pieces having a first plurality of game pieces of a first valuation, a second plurality of game pieces of a second valuation superior to the first valuation and a third plurality of game pieces of a third valuation superior to the second valuation and inferior to the first valuation, means for stacking said game pieces only in ascending order of valuation upon selected ones of said positions of said game board, said method comprising the step of:

(a) alternately locating game pieces of the first and second sets upon a position of the game board;

(b) alternately stacking game pieces of the first and second sets upon game pieces previously placed upon a position of the game board; and (c) repeating one of said locating and stacking steps until game pieces of one of the sets of game pieces become arranged on the game board in a predetermined arrangement.

18. The method as set forth in claim 17 wherein said step of stacking includes the step of nesting the game pieces.

19. The method as set forth in claim 18 wherein said step of nesting includes the step of interlocking the game pieces to prevent relative rotation between stacked ones of the game pieces.

20. The method as set forth in claim 19 wherein said step of interlocking includes the step of interlocking a game piece placed on the game board with the game board.

21. The method as set forth in claim 20 wherein said step of stacking includes the step of stacking the game pieces in ascending valuation.

22. The method as set forth in claim 17 wherein said step of repeating includes the step of locating and stacking game pieces of a predetermined valuation uppermost in the arrangement sought.

23. The method as set forth in claim 17 wherein said step of stacking includes the step of stacking the game pieces in ascending valuation.

24. The method as set forth in claim 23 wherein said step of stacking includes the step of interlocking the game pieces to prevent relative rotation between stacked ones of the game pieces.

25. The method as set forth in claim 24 wherein said step of interlocking includes the step of interlocking a game piece placed on the game board with the game board.

* * * * *